US006755142B2

(12) United States Patent
Rice

(10) Patent No.: US 6,755,142 B2
(45) Date of Patent: Jun. 29, 2004

(54) MODULAR PONTOON SYSTEM

(76) Inventor: Thomas Rice, 180 Rosemary Lane, Ancaster, ONT. (CA), L9G 2K7

( * ) Notice: Subject to any disclaimer, the term of this patent is extended or adjusted under 35 U.S.C. 154(b) by 130 days.

(21) Appl. No.: 10/028,682

(22) Filed: Dec. 28, 2001

(65) Prior Publication Data

US 2003/0121463 A1 Jul. 3, 2003

Related U.S. Application Data

(60) Provisional application No. 60/258,491, filed on Dec. 29, 2000.

(51) Int. Cl.[7] ..... B63B 3/08
(52) U.S. Cl. ..... 114/61.1; 114/352
(58) Field of Search ..... 114/61.1, 352, 114/292, 266, 267

(56) References Cited

U.S. PATENT DOCUMENTS

| | | | | | |
|---|---|---|---|---|---|
| 2,879,735 | A | | 5/1959 | Pointer | |
| RE24,837 | E | | 6/1960 | Usab | |
| 3,448,709 | A | | 6/1969 | Hardwick, Jr. | |
| 3,614,937 | A | * | 10/1971 | Schulman | 114/283 |
| 3,664,285 | A | * | 5/1972 | Rabideau | 114/267 |
| 3,673,976 | A | * | 7/1972 | Reynolds | 114/61.22 |
| 3,977,344 | A | * | 8/1976 | Holford | 114/263 |
| 4,768,456 | A | | 9/1988 | Jones et al. | |
| 5,355,825 | A | | 10/1994 | Lefebvre et al. | |
| 5,540,169 | A | * | 7/1996 | Davis et al. | 114/61.1 |
| 5,947,049 | A | | 9/1999 | Elson | |

* cited by examiner

*Primary Examiner*—Sherman Basinger
(74) *Attorney, Agent, or Firm*—E. H. Oldham

(57) ABSTRACT

A pontoon system comprising a series of hollow plastic modular units held together in a string under a watercraft is disclosed. The string may be compressed so as to form a unitary pontoon. If the compression force holding the individual pontoon member is released, any individual pontoon member which has been damaged may be removed and replaced without having to remove the watercraft from the water.

12 Claims, 4 Drawing Sheets

54
56
52
56
56
56
62
64
58
60
28
28
24
32
28
14
28
66
26
10

MODULAR PONTOON SYSTEM

This application claims the benefit under Title 35 U.S.C. §119 (e) of U.S. Application No. 60/258,491 filed Dec. 29, 2000.

FIELD OF INVENTION

This invention relates to a pontoon assembly for watercraft which comprises a series of modular pontoon assemblies (modules) which may be linked together to form an integrated pontoon. The modular components are similarly shaped (with the exception of the bow and stem modules) and each module is provided with a mating face surface profile which ensures that two adjacent modules may be easily assembled together in an interlocked relationship at the mating faces. When a series of such modules are assembled together with the mating faces interlocked together, the result is complete pontoon having all the floatation advantages associated with the prior art single unit pontoon assembly in common use today but in addition allows for fast and speedy replacement of any part of the pontoon assembly which might be damaged during use. It is not necessary to remove the entire pontoon assembly to replace one of the modular components.

Each module of this invention is preferably formed from a tough plastic material which is capable of undergoing substantial distortion without experiencing rupture. Such modules may be successfully formed through blow molding or by a centrifugal casting process. The result is a tough durable lightweight module which when assembled together with a series of like modules may ultimately be formed into an integral pontoon which is capable of replacing the standard metallic pontoons used on watercraft etc. The resulting pontoon composed of a plurality of interlocking modules is available at a fraction of the price of the elongated metallic cylindraceous pontoons of the prior art. Individual modules in the completed pontoon may be easily removed and replaced without the requirement of complete removal of the entire pontoon from the watercraft. The prior art pontoons either require complete removal of the pontoon or the raising of the watercraft with sophisticated lifting equipment to enable a repair to the pontoon whilst it is still attached to the watercraft.

BACKGROUND OF THE INVENTION

Pontoons have been used to supply floatation for houseboats, barges, docks, rafts, bridges, etc. for years. Prior art pontoons have usually taken the shape of an elongated, hollow metal cylinder and in instances where the pontoons are used as floatation devices for moving watercraft, etc. the leading and trailing portions of the pontoon are usually shaped to minimize the resistance to motion of the pontoon through the water.

Recently pontoons have been developed which are more of a modular nature and which have been used for docks, rafts and other stationary floating objects so that the floatation may be adjusted by adding more units to the floating raft or dock assembly. The versatility of the modular concept for floatation devices has led to wide acceptance of hollow plastic pontoon modules for docks and rafts etc.

Pontoons for houseboats and other moving watercraft have generally been fabricated from sheet metal stock to form a hollow, cylindrical, metallic vessel on which a superstructure is mounted.

Over the years, pontoon equipped houseboats have suffered from one serious deficiency. If the metallic pontoon suffered puncture damage anywhere along its length it is necessary to raise the pontoon out of the water in order to be able to carry out a repair. This necessitated that the houseboat be tipped in some fashion or other or that the entire craft be lifted out of the water to effect a successful repair. At times it will be found that if the damage to the pontoon is severe enough, the entire pontoon must be removed from the watercraft to effect a satisfactory repair.

It is well recognized that a large industry has evolved in which pontoon equipped houseboats are rented to vacationing persons who have had little or no experience in operating watercraft of this type and size. As a result, it is not unusual for a novice to damage the pontoons on such rented watercraft. Repairing damaged pontoons can be prohibitively expensive.

SUMMARY OF THE INVENTION

The modular pontoon assemblies of this invention may be ideally applied to applications such as houseboats and other types of watercraft such as barges, sightseeing craft, etc. which are not primarily intended for operation at high speeds, but where damage to the pontoon assemblies is an occupational hazard. The modular pontoon assembly of this invention is formed of a series of identically shaped hollow molded plastic modules which are quite resilient and which have the ability to distort upon impact without suffering puncturing damage. The material is resistant to tearing etc. when subjected to unintentional scraping or abrasive scrubbing on the pontoon surface.

The pontoons themselves are formed into a predetermined shape so as to keep the resistance low when the watercraft is in motion, and the sides of the pontoon are shaped to add increased resistance to impact damage during docking and mooring.

Each pontoon is provided with a pair of spaced apart upright parallel flanges at the upper surface thereof in which a series of spaced transverse bolt holes are formed. A pair of substantially "C" shaped pontoon rails are supplied on the mounting craft to engage the flanges on their outside surfaces for mounting the pontoons on a watercraft. The flanges of the pontoons are formed to be spaced apart sufficiently to thus fit between the "C" shaped pontoon rails. There is just sufficient clearance between the rails and flanges to allow the flanges formed on the top of each pontoon module to slide between the pontoon rails. When a pontoon is located in the desired position and location between the pontoon rails, one or more through bolts are passed through the matching holes in the rails and the upright flanges on the top of the pontoon module to fix the pontoon to the watercraft.

The complete pontoon for a watercraft may comprise several modules serially mounted on the pontoon rails to provide the desired floatation. The modules at each end of the pontoon assembly preferably have a curved water engaging surface (similar to a ski) to cut down losses when the craft is moving. The mounted modules are preferably maintained in a state of compression in the string. They are pressed together by a jacking means or a winch to ensure a tight fit between adjacent modules forming the complete pontoon. The through bolts passing through the pontoon rails may be tightened to secure each module in its "home" position on the pontoon rails after the modules have been pressed together.

PERTINENT PRIOR ART

U.S. Pat. No. 5,355,825 Oct. 18, 1994

This patent is directed to an aquatic float the primary purpose of which is to supply floatation for aquatic structures such as docks, rafts or platform boats etc. The float is of a modular type having a pair of upright longitudinal flanges formed in the top surface thereof embrace "standard dimensional lumber". The longitudinal flanges are provided with moulded in place fastener receivers.

U.S. Pat. No. 4,768,456 Sep. 6, 1988

This patent describes a modular float system which is ideally suited for docks and rafts. The patent describes a floating platform, the buoyancy of which is provided by large hollow plastic floats, which are serially held in place by a raft assembly which is mated into grooves formed in the top of each module. In this instance, the mating plastic grooves are provided with ridges to tightly engage the mating members of the raft assembly.

Each module is provided with an interlocking surface of mating with the adjacent module so that the integrity of the float assembly is maintained.

This assembly which is directed to floating docks and rafts might be adaptable for use as a pontoon assembly for a houseboat etc. but the construction of the interlocking raft and float surfaces is such that each module tends to be "locked" in place one the raft members have been properly seated in the provided recesses in the top of the float surface. It would almost require a jacking device to separate a float module from the raft. The interlocking assembly (dove tail) shown in FIGS. 5 and 6 may yield further problems for separation of adjourning floats if one float must be removed from the system U.S. Pat. No. 5,947,049 Sep. 7, 1999

This invention relates to a boat lift or a walkway which comprises a set of hollow plastic modules which are mounted on a pair of rails by means of through bolts. Because of the configuration of the device of this invention, it is not applicable to the pontoon assembly of this invention.

U.S. Pat. Re No. 24837 Jun. 4, 1960

U.S. Pat. No. 2,879,735 May 31, 1959

U.S. Pat. No. 3,448,709 Jun. 10, 1969

DESCRIPTION OF THE PREFERRED EMBODIMENT

Figure 1:
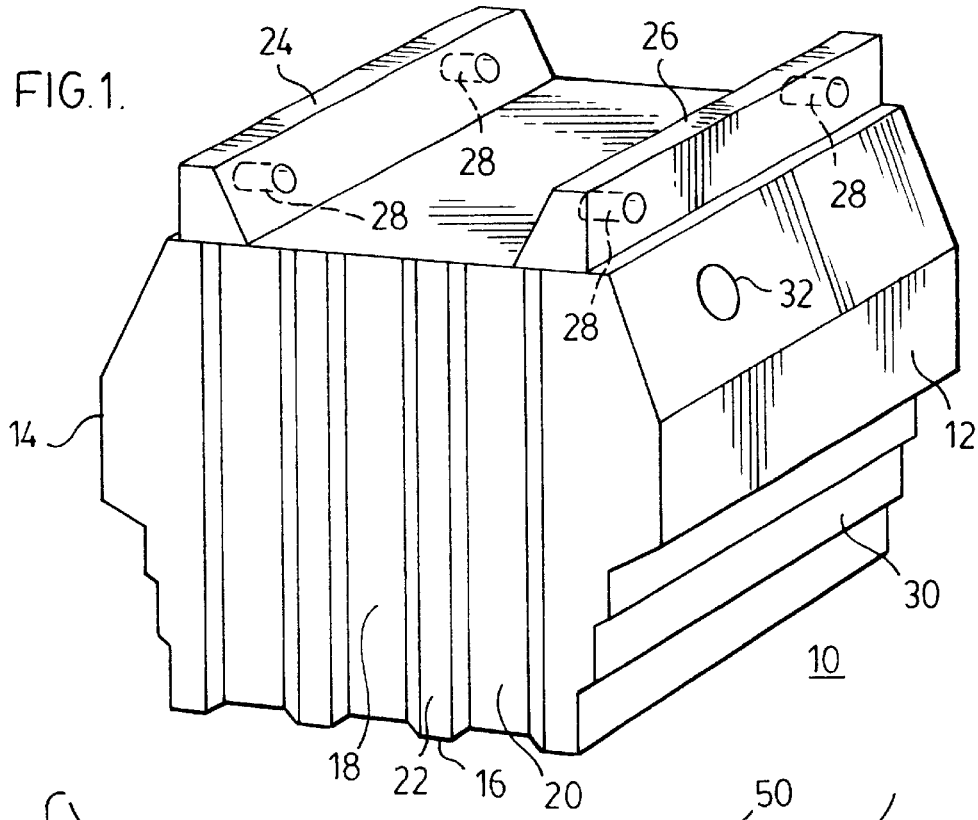
FIG. 1 is a perspective view of a modular pontoon assembly of this invention.

Referring now to FIG. 1, a pontoon module 10 is shown, which is preferably formed of a tough plastic material manufactured and sold by Agri Plastic such as LLPE polyethylene.

Module 10 is shaped to have protruding bulging sides 12 and 14 which function as protective "bumpers" for the complete pontoon assembly during docking operations.

The lower surface 16 is supplied with a ribbed type corrugation type surface which adds additional strength to the bottom of the pontoon module.

Both ends 18 (only one of which is shown) are provided with a ridged surface comprising depressions 20 and upstanding ridges 22 which yield an interlocking surface having a substantial degree of robustness. This is necessary because adjacent modules are purposely made to interlock with each other in the final assembly of the complete pontoon assembly.

The top surface of the pontoon module 10 is provided with a pair of upstanding longitudinally extending flanges 24 and 26 which are used to mount each module on a designated watercraft.

Each flange has at least one cast-in-place sleeve such as 28 which is sealed in the flanges 24 and 26 of module 10.

It is to be noted that other ribbing such as 30 is present on the side surfaces of module 10 to add increased strength to the module.

Each module is also provided with a removable seal plug 32 in the top surface thereof.

Figure 2:
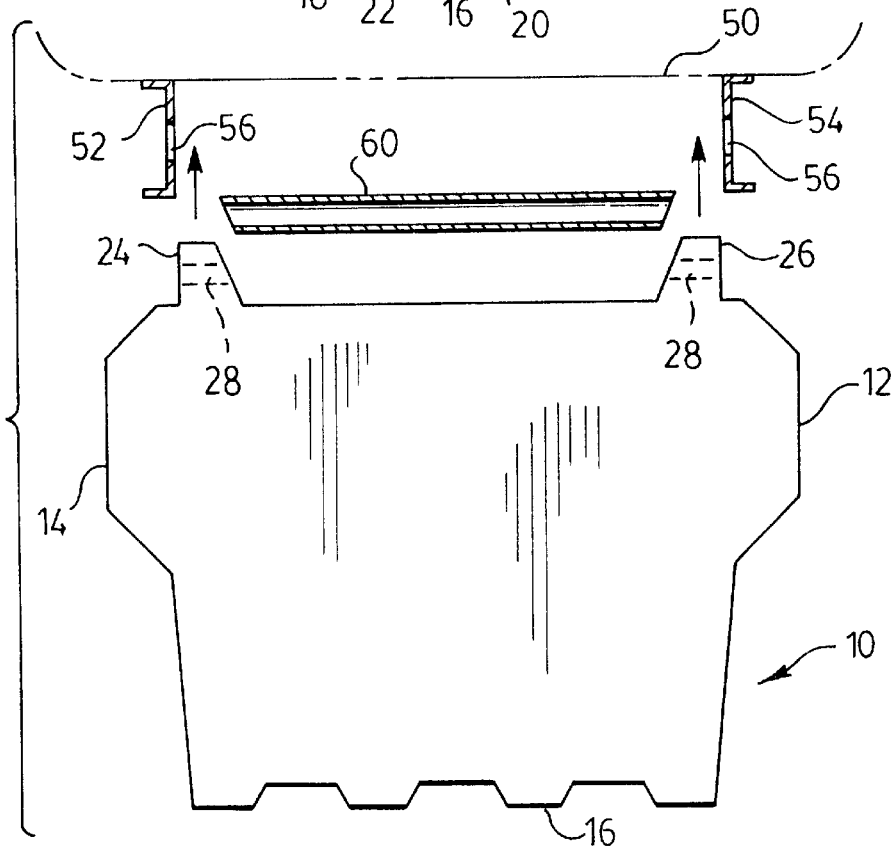
FIG. 2 shows the pontoon module and its associated hardware used to mount the module to a watercraft.

FIG. 2 shows how a watercraft 50 having a pair of metallic channel members 52 and 54 mounted thereon may receive individual pontoon modules 10 therebetween. The flanges 24 and 26 of module 10 are made to be received between channels 52 and 54 in a sliding fit. Channels 52 and 54 are provided with elongated matching mounting holes 56 for receiving a mounting bolt 58 therein (see FIG. 3). A hollow quill 60 is provided to receive bolt 58 and provide a spacer between the sleeves 28 in flanges 24 and 26.

Bolt 58 is provided with a pivoting locking key 62 at one end and a threaded portion 64 at the remote end.

Figure 3:
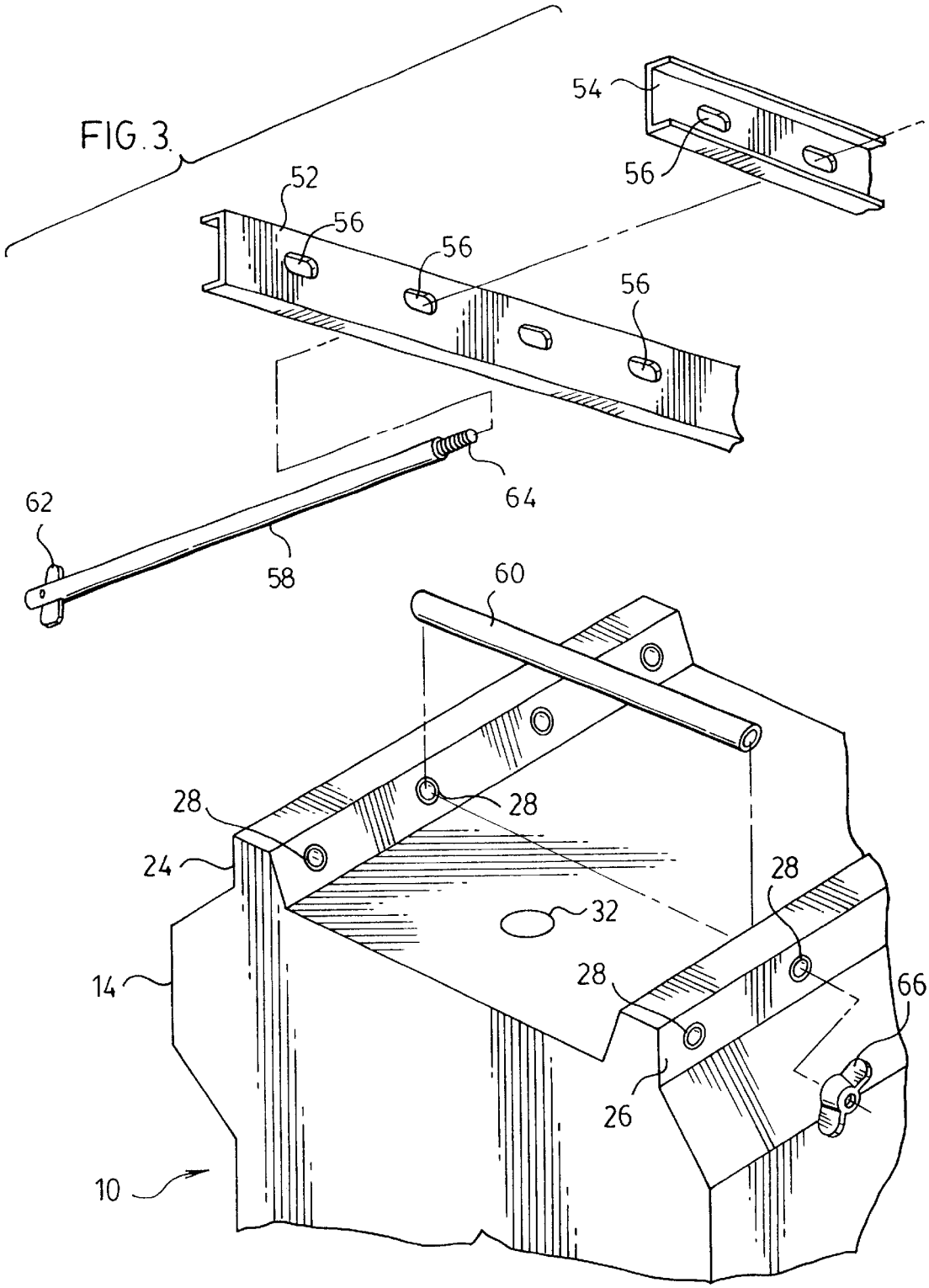
FIG. 3 shows a perspective illustration of the pontoon and apparatus used to secure the module to the hardware of the watercraft.

Key 62 when axially aligned with bolt 58, allows the swift insertion of the bolt 58 into the mounting assembly comprising rails 52, 54 and flanges 24 and 26 containing sleeves 28. A wing nut 66 is shown in FIG. 3 to mate with threaded portion 64 of bolt 58.

Figure 4:
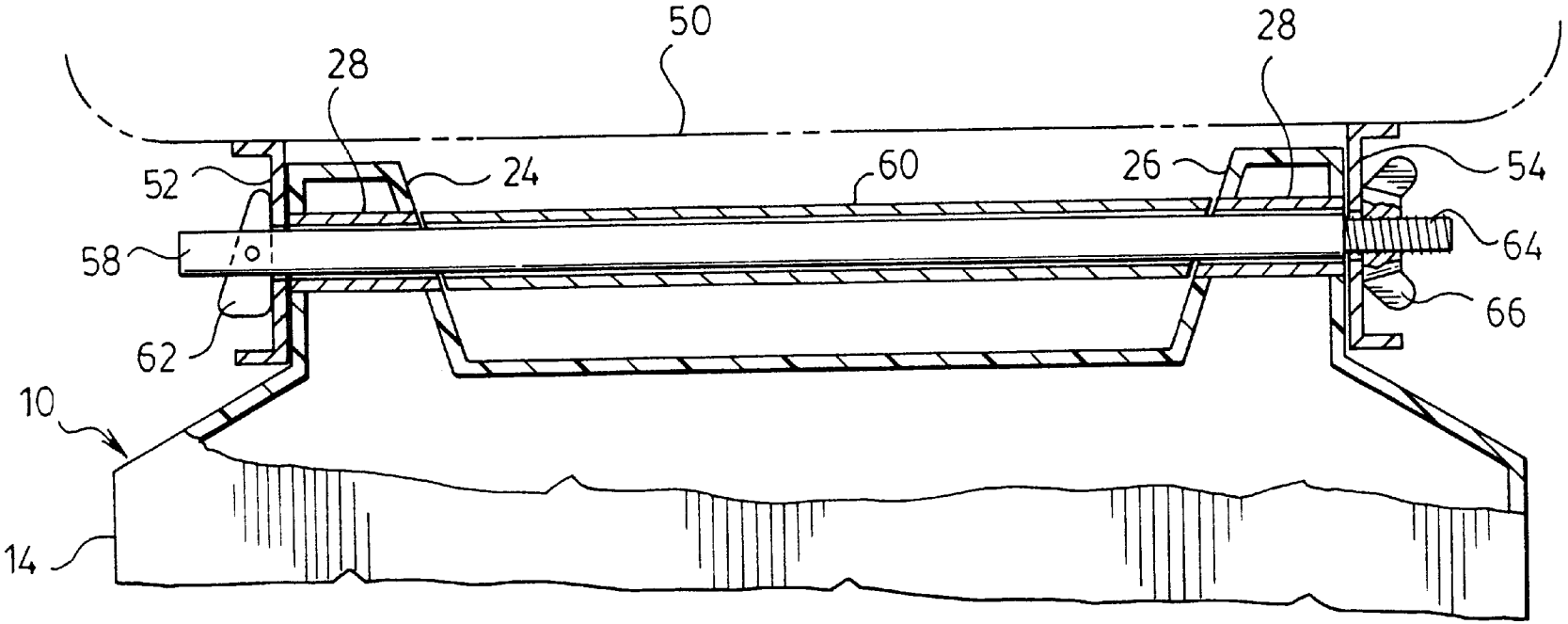
FIG. 4 is a sectional view of the mating arrangement for a pontoon module into the mounting hardware of the watercraft.

FIG. 4 shows a sectional view of the method of attachment of module 10 to the rails 52 and 54 of watercraft 50.

The presence of spacer quill 60 between sleeves 28 allows the nut 66 to be tightened securely and the predetermined constant spacing of the rails 52 and 54 is assured because of this construction.

Note that holes 56 are elongated so that there is a limited degree of freedom for modules 10 to move longitudinally along the rails 52 and 54. This degree of freedom is provided so that the individual modules 10 of a complete pontoon assembly are free to move along rails 52 and 54 when supplied with a compressive force, so that the interlocking end surfaces 16 of adjacent modules are pressed together to form an integral pontoon assembly.

Figure 5:
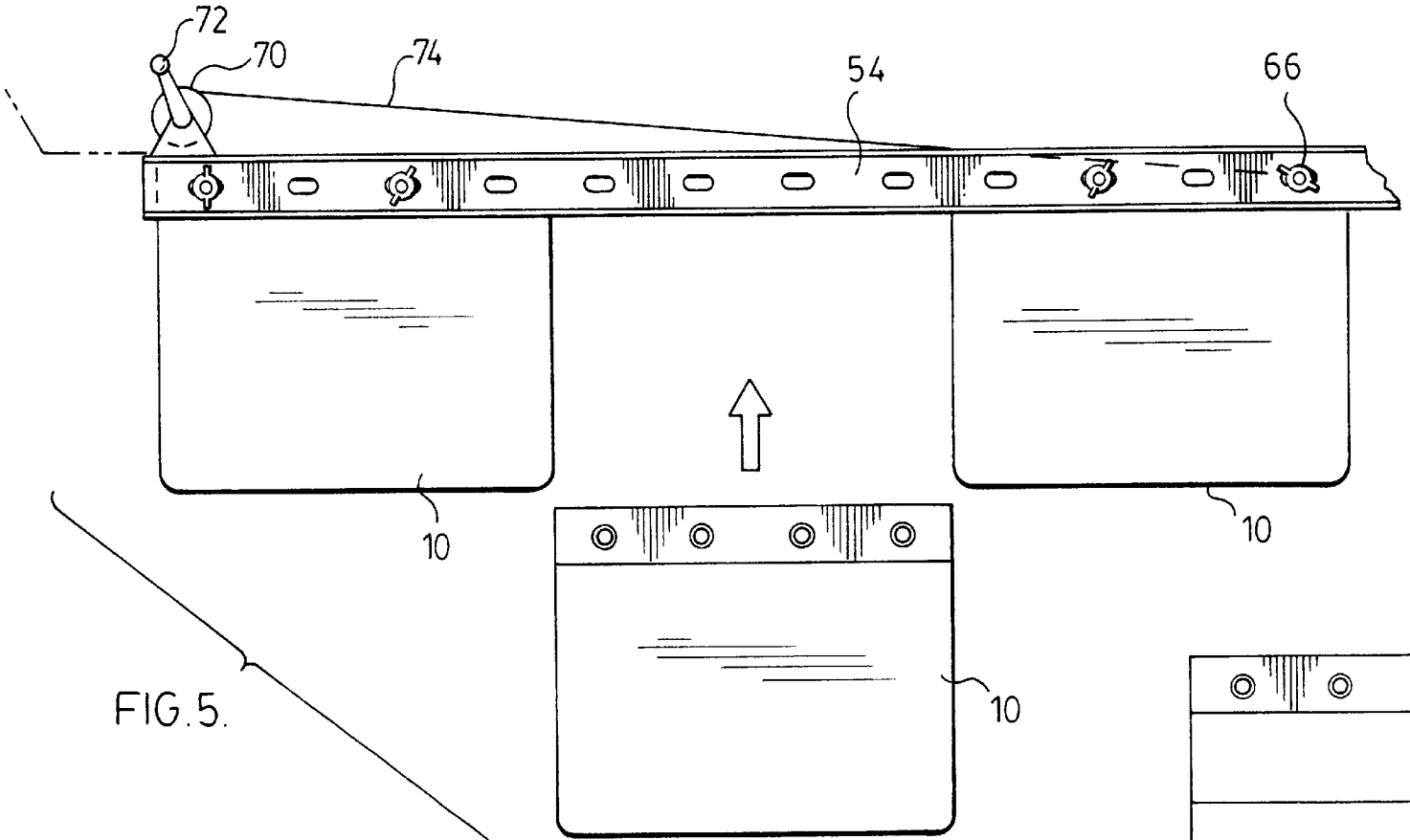
FIG. 5 is an illustration of the method of replacement of a pontoon module from a pontoon assembly.
Figure 6:
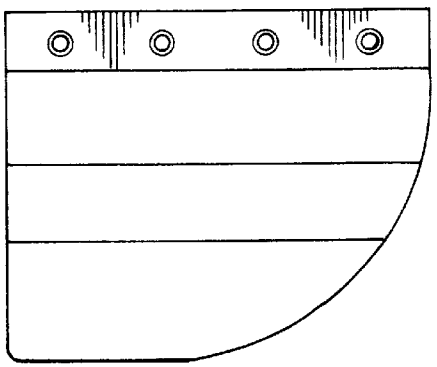
FIG. 6 is an illustration of a bow or stern pontoon module.

A winch assembly 70 operated by handle 72 is shown in FIG. 5 having cable 74 attached to a remote module is used for pulling the modules 10 together in the final assembly.

To remove a damaged module from an assembly winch 70 is released to relax cable 74. Nuts 68 are loosened to allow the modules 10 to move apart slightly. The damaged module in all probability will have suffered a puncture and will have neutral or negative buoyancy. When the bolts 58 and spacers 60 have been removed from the mounting rails 52 and 54 the damaged module 10 may be easily removed by allowing it to slide downwardly from the pontoon assembly without the need of jacks or prybars, etc. The replacement module (which may be filled with water to establish neutral buoyancy) is lowered to a location below and between the two modules in the assembly (see FIG. 5) from where the damaged module was removed. When the interlocking surfaces 16 of the modules on either side of the replacement module are properly mated, the replacement module may be slid upwardly between the adjacent modules and mounted between rails 52 and 54 using bolts 58 and quills 60.

Since all the nuts 68 of the pontoon assembly had previously been relaxed, the modules 10 of the pontoon assembly may now be compressed together by operating winch 70. When the desired degree of compression of the modules has been achieved, nuts 68 are tightened to permanently lock the modules 10 in place on rails 52 and 54.

The replacement module may now be emptied of its ballast water by pumping the contained water out of the module through the opening provided for the seal plug 32. Normal buoyancy is thus restored without having to "dry-dock" the watercraft or lift the craft with a crane.

The advantages of the pontoon modules of this invention are many:

1. Because the pontoon assemblies of this invention are primarily intended for use on watercraft such as houseboats, the pontoon modules must be capable of withstanding severe side thrusts occurring during docking or other unintentional acts resulting from improper operation by persons not possessing true boating skills. The location of flanges 24 and 26 on each module 10 provides a significant degree of strength to the module to prevent twisting of the module when properly mounted between rails 52 and 54. These modules will be subjected to impacts on the side of the module during a docking operation which apply torques to the individual modules which tend to twist the module in the mounting channels 52 and 54. Because of the distance between the flanges 24 and 26, the module is able to absorb the side thrust imposed on it without suffering damage.
2. Provision is made for "locking" the modules into an integral assembly by some form of compression means (winch 70) to provide a continuous surface uninterrupted by spaces between adjacent modules. This strengthens the completed assembly.
3. The pontoon modules may be easily replaced by unskilled personnel who have no access to cranes or other dry docking equipment.
4. The pontoon modules of this invention are capable of winter exposure in ice, thus watercraft so equipped do not have to be protected from the water freezing during the winter season. Thus the storage efficiency of the watercraft bearing these pontoons is significantly enhanced.
5. The modules of this invention may be ideally applied to pontoon floats for aircraft.

What is claimed:

1. A pontoon for a watercraft comprising:

a series of hollow modules having means to permit said modules to be filled with water, of similar shape mounted on the bottom of said watercraft to form a chain of interlocked modules, said modules having complimentary mating surfaces comprising a plurality of vertically extending spaced parallel ridges extending from the top to the bottom surface of said modules at the point of engagement with each other, and compression means supplied to said watercraft for compressing said chain of modules together.

2. A pontoon as claimed in claim 1 wherein said modules are made from a tough plastic material.

3. A pontoon as claimed in claim 2 wherein said modules have a pair of substantially parallel spaced apart upstanding flanges formed in the top surface thereof for attachment to said watercraft.

4. A pontoon as claimed in claim 3 wherein said watercraft is supplied with a pair of mounting rails for mounting said modules on said watercraft, wherein said flanges on the top surface of each module slidingly engage said mounting rails on said watercraft.

5. A pontoon as claimed in claim 4 wherein each of said modules are fastened to said rails in such a manner as to provide for a predetermined amount of movement of each module in a direction along the length of the rail.

6. A pontoon as claimed in claim 5 wherein bolt means is supplied to pass through said flanges and said rails to secure said modules to said rails.

7. A pontoon as claimed in claim 5 wherein each module is shaped to have bulging sides to act as a bumper during mooring and docking.

8. A pontoon as claimed in claim 7 wherein each module is provided with an orifice in the top surface thereof to permit inspection and maintenance procedures and filling and emptying the module with water.

9. A pontoon as claimed in claim 8 wherein a sealing plug is supplied to each orifice.

10. A module for a pontoon assembly comprising:

a hollow plastic vessel having top, bottom, side and end surfaces integrally connected to each other, said top and bottom surfaces being relatively flat, said top surface having a pair of spaced apart substantially, parallel upstanding flanges extending along said top surface between said end surfaces, said top surface being provided with a closable aperture to permit filling and evacuation of said module, said side surfaces having bulging portions extending beyond said top and bottom surfaces, said end surfaces having complimentary surface profiles comprising interlocking vertical extending ridges extending from the top to the bottom surface of the module formed therein for maintaining adjacent modules in registry.

11. A pontoon assembly for a watercraft comprising:

a pair of longitudinally extending spaced apart rails mounted on watercraft, each rail being provided with a series of openings at predetermined locations for securing pontoon modules thereto, a plurality of hollow pontoon modules having suitable openings therein for filling and evacuating said modules, each module being of predetermined shape each having a substantially flat top surface having a pair of spaced apart parallel opposing upstanding flanges formed in the top surface of each module at the edges of the top surface to fit between the rails of said watercraft, each of said flanges having bolt retaining means formed therein to correspond to said openings, bolt means passing through said openings in said rails and through bolt retaining means in said modules, compressive means on said watercraft for said pontoon assembly for compressing said modules together.

12. A pontoon module for watercraft comprising a hollow float having top and bottom side and end surfaces;

said top surface being supplied with a closable aperture and at least two spaced apart upstanding mounting flanges adjacent said module sides, said end surfaces having a plurality of spaced parallel interlocking mating vertical grooves extending from the top surface to the bottom surface of said module formed in each module for maintaining adjacent module end surfaces in registry, said flanges being provided with means for mounting said module to a houseboat.

* * * * *